US009236180B2

(12) United States Patent
Kim et al.

(10) Patent No.: US 9,236,180 B2
(45) Date of Patent: Jan. 12, 2016

(54) INDUCTOR AND MANUFACTURING METHOD THEREOF

(71) Applicant: Samsung Electro-Mechanics Co., Ltd., Suwon (KR)

(72) Inventors: Jae Kwang Kim, Suwon (KR); Sang Ho Shin, Anyang (KR); Byung Kug Cho, Suwon (KR); Hoon Suk Hur, Hwasung (KR)

(73) Assignee: Samsung Electro-Mechanics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/095,336

(22) Filed: Dec. 3, 2013

(65) Prior Publication Data

US 2014/0152411 A1 Jun. 5, 2014

(30) Foreign Application Priority Data

Dec. 4, 2012 (KR) ..... 10-2012-0139702

(51) Int. Cl.

| | |
|---|---|
| ***H01F 27/29*** | (2006.01) |
| ***H01F 27/02*** | (2006.01) |
| ***H01F 27/06*** | (2006.01) |
| ***H01F 7/06*** | (2006.01) |
| ***H01F 41/06*** | (2006.01) |

(52) U.S. Cl.

CPC ..... *H01F 27/06* (2013.01); *H01F 41/06* (2013.01); *H01F 2027/065* (2013.01); *Y10T 29/49071* (2015.01)

(58) Field of Classification Search

CPC ..... H01F 17/045; H01F 27/06; H01F 27/26; H01F 27/30; H01F 41/06; H01F 27/29; H01F 2027/065; H01F 3/08; H01F 17/04; Y10T 29/4907

USPC ..... 336/192, 83, 233; 29/605

See application file for complete search history.

(56) References Cited

U.S. PATENT DOCUMENTS

| | | | | |
|---|---|---|---|---|
| 4,725,805 | A * | 2/1988 | Takada | 336/83 |
| 5,266,739 | A * | 11/1993 | Yamauchi | 174/540 |
| 2004/0164834 | A1* | 8/2004 | Tolle et al. | 336/198 |
| 2007/0030106 | A1* | 2/2007 | Furuya | 336/83 |
| 2010/0321143 | A1* | 12/2010 | Satake et al. | 336/192 |
| 2011/0291783 | A1* | 12/2011 | Yamada et al. | 336/192 |
| 2013/0194060 | A1* | 8/2013 | Nakada et al. | 336/192 |

FOREIGN PATENT DOCUMENTS

| | | |
|---|---|---|
| JP | 2008-218950 | 9/2008 |
| JP | 2009-4670 | 1/2009 |
| JP | 2011-14822 | 1/2011 |

* cited by examiner

*Primary Examiner* — Mangtin Lian

(74) *Attorney, Agent, or Firm* — McDermott Will & Emery LLP

(57) ABSTRACT

Disclosed herein are an inductor and a manufacturing method thereof. The manufacturing method of an inductor includes: positioning a printed circuit board (PCB) including a predetermined pattern formed thereon and an insertion part formed at one side thereof; fixing a protrusion part formed at a lower portion of a core so as to be inserted into the insertion part; electrically connecting both ends of a coil wound around the core to a lower PCB terminal disposed at a lower portion of the PCB, respectively; and forming an appearance so that the core, the coil, and an upper exposed surface of the PCB are received therein.

8 Claims, 3 Drawing Sheets

FIG. 1 - PRIOR ART
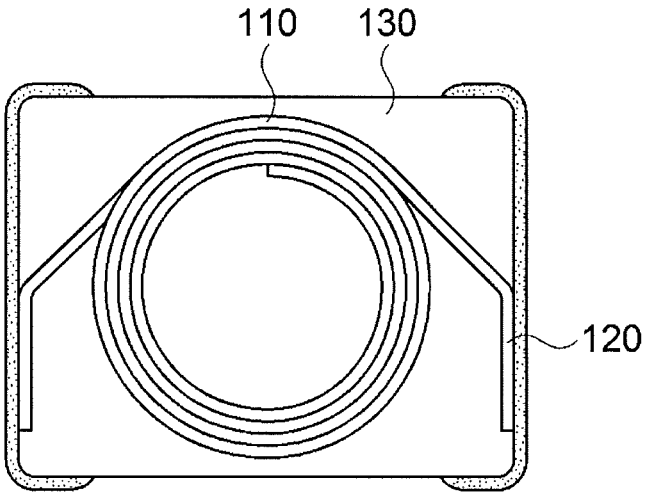
FIG. 2
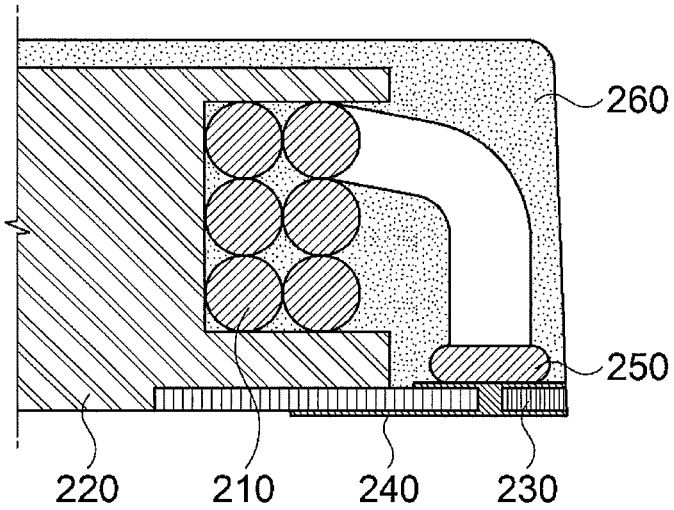
FIG. 3A
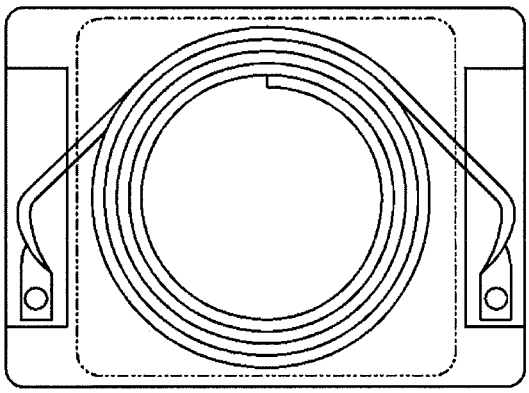

INDUCTOR AND MANUFACTURING METHOD THEREOF

CROSS REFERENCE(S) TO RELATED APPLICATIONS

This application claims the foreign priority benefit of Korean Patent Application Serial No. 10-2012-0139702, entitled "Inductor and Manufacturing Method Thereof" filed on Dec. 4, 2012, which is hereby incorporated by reference in its entirety into this application.

BACKGROUND OF THE INVENTION

1. Technical Field

The present invention relates to an inductor and a manufacturing method thereof.

2. Description of the Related Art

In accordance with the recent trend toward development of low voltage and large current electronic devices, it is important to develop an inductor provided in the corresponding device so as to correspond to a large current.

Since a peak value of current is increased by a large current, an inductor simultaneously having high inductance for suppressing and smoothening the peak value, or the like, and low resistance for suppressing a loss, heat generation, and a decrease in power efficiency by a coil resistance component has been required.

FIG. 1 is a view showing an inductor manufactured according to the related art.

An appearance of the inductor shown in FIG. 1 is formed using a forming mold in a method of winding and exposing an internal winding (coil 110) to the outside using a mold type and drawing an external electrode 120 from the exposed coil 110.

Here, in a filler 130 for forming the appearance, a material obtained by mixing metallic magnetic powder and a resin with each other is used.

However, in a manufacturing method of an inductor according to the related art, a mold type using an individual mold of a product is used, such that productivity may be deteriorated.

Further, in order to remove covering of a surface of the coil exposed in order to draw the external electrode, a mechanical method or a method of using laser should be additionally considered, and the inductor should have a complicated layer structure such as silver (Ag) plating, nickel plating, tin (Sn) plating, or the like.

SUMMARY OF THE INVENTION

An object of the present invention is to provide an inductor capable of being miniaturized and having excellent mounting capability on a substrate, and a manufacturing method thereof.

Another object of the present invention is to provide an inductor capable of maximizing a filling ratio and simultaneously implementing large capacity and thinness by having a core in order to efficiently mount an internal electrode and using a material having a magnetic property as a core material, and a manufacturing method thereof.

Other objects of the present invention will be easily understood through the following descriptions.

According to an exemplary embodiment of the present invention, there is provided an inductor including: a printed circuit board (PCB) including an insertion part formed therein; a coil assembly including a core and a coil wound around the core and positioned on the PCB so that a protrusion part formed at a lower portion of the core is inserted and fixed into the insertion part; a lower PCB terminal disposed at a lower portion of the PCB and penetrating through the PCB to thereby be electrically connected to the coil; and a filler forming an appearance so that the core, the coil, and an upper exposed surface of the PCB are received therein.

A content of a resin configuring the core may be less than 1 wt %, and a content of a resin configuring the filler may be an arbitrary value of 4 to 10 wt %.

At least one groove for fixing the other end of the coil at the time of winding the coil on a circumferential surface of the core using one end of the coil may be formed at one side of the core.

The coil and the lower PCB terminal may be electrically connected by at least one method among a laser welding method, a spot welding method, an ultrasonic welding method, and a conductive adhesive bonding method.

According to another exemplary embodiment of the present invention, there is provided a manufacturing method of an inductor, the manufacturing method including: positioning a printed circuit board (PCB) including a predetermined pattern formed thereon and an insertion part formed at one side thereof; fixing a protrusion part formed at a lower portion of a core so as to be inserted into the insertion part; electrically connecting both ends of a coil wound around the core to a lower PCB terminal disposed at a lower portion of the PCB, respectively; and forming an appearance so that the core, the coil, and an upper exposed surface of the PCB are received therein.

The fixing of the protrusion part may be fixing a coil assembly in which the coil is wound on a circumferential surface of the core so as to be inserted into the insertion part.

The fixing of the protrusion part may include: fixing the protrusion part formed at the lower portion of the core so as to be inserted into the insertion part; and winding the coil on a circumferential surface of the fixed core.

Other aspects, features, and advantages of the present invention except for the above-mentioned contents will become obvious from the following drawings, accompanying claims, and a detailed description of the present invention.

BRIEF DESCRIPTION OF THE DRAWINGS

FIG. 1 is a view showing an inductor manufactured according to the related art.

FIG. 2 is a view showing a structure of an inductor according to an exemplary embodiment of the present invention.

FIGS. 3A to 3C are a plan view and cross-sectional views of the inductor according to the exemplary embodiment of the present invention.

DESCRIPTION OF THE PREFERRED EMBODIMENTS

Figure 3B:
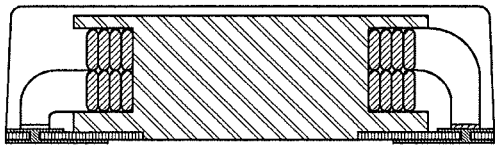

The present invention may be variously modified and have various types, and specific embodiments of the present invention will be described in detail with reference to the accompanying drawing. However, the present invention is not limited to the exemplary embodiments described herein, but all of the modifications, equivalents, and substitutions within the spirit and scope of the present invention are also included in the present invention.

Terms used in the present specification are used in order to describe specific exemplary embodiments rather than limiting the present invention. Singular forms used in the specification are intended to include plural forms unless the context clearly indicates otherwise. Terms such as "include", "have", and the like, used in the present specification will imply the existence of stated features, numbers, steps, operations, configuration elements, components, or a combination thereof, but do not exclude other features, numbers, steps, operations, configuration elements, components, or a combination thereof.

In describing the present invention with reference to the accompanying drawings, the same reference numerals will be used to describe the same or like components, independent of the reference numerals and an overlapped description of the same components will be omitted. Further, when it is determined that the detailed description of the known art related to the present invention may obscure the gist of the present invention, the detailed description thereof will be omitted.

Figure 3C:
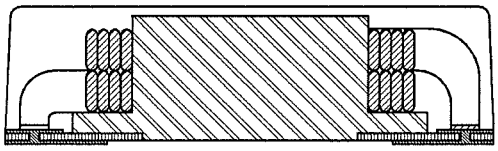
Figure 4A:
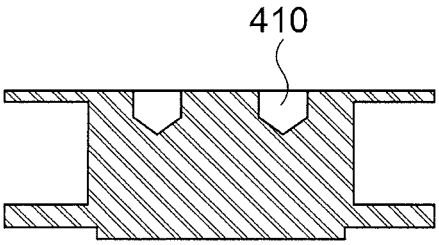
FIGS. 4A and 4B are views showing a shape of a core according to the exemplary embodiment of the present invention.
Figure 4B:
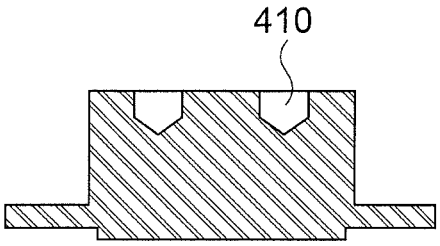

FIG. 2 is a view showing a structure of an inductor according to an exemplary embodiment of the present invention, FIGS. 3A to 3C are a plan view and cross-sectional views of the inductor according to the exemplary embodiment of the present invention, and FIGS. 4A and 4B are views showing a shape of a core according to the exemplary embodiment of the present invention.

As shown in FIGS. 2 to 3C, the inductor according to the exemplary embodiment of the present invention is has a structure in which a coil 210 is wound around a separate core 220, the core 220 having the coil 210 wound therearound is mounted on a printed circuit board (PCB) 230, the coil 210 is electrically connected to a lower PCB terminal 240 positioned at a lower portion of the PCB 230 in order to be electrically conducted, an external electrode is drawn downwardly.

Therefore, a separate process for drawing the external electrode is not required, and post-treatment required in the external electrode such as plating, or the like, may be performed on the lower PCB terminal 240, such that the process may be simplified.

The coil 210 and the lower PCB terminal 240 are electrically connected, for example, by at least one method among a laser welding method, a spot welding method, an ultrasonic welding method, a conductive adhesive bonding method, and the like, and an electrically connected site is shown as a connection part 250 in FIG. 2. The coil 210 has a bending structure for electrical connection with the PCB 230.

The coil 210 wound around the core 220 may have various shapes such as a square shape and an annular shape shown in FIGS. 3B and 3C, respectively, and a material of the coil 210 may be, for example, copper (Cu).

In addition, the coil 210, and the core 220 having the coil 210 wound therearound, and an upper surface of the PCB 230 may be received in the inductor, and an appearance of the inductor may be formed using a filler 260.

The filler 260 may be, for example, a material obtained by mixing metallic magnetic powder and a resin with each other. In this case, a content of the resin may be 4 to 10 wt %. On the other hand, a content of a resin used to form the core 220 may be, for example, less than 1 wt %, or the resin is not included therein, such that the content is different from that of the resin configuring the filler 260.

That is, the core 220 is manufactured in a form in which the content of the resin is significantly small or zero by a separate molding and sintering method. However, since a process of forming the appearance using the filler 260 is a difficult process to be performed by molding, a filling property is improved by increasing the content of the resin.

The core 220 is manufactured by the molding and sintering method, and a sintering temperature may be, for example, 600 to 1200° C.

As shown in FIGS. 3B and 3C, respectively, the core 220 may be formed in a 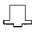 or 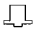 shape in which a lower protrusion part is formed in order to be inserted into and fixed to an insertion part, which is a hole or groove formed in the PCB 230, and an outer portion of the core 220 may have an insulating property by coating and forming an oxide film.

In addition, a circumference of the core 220 may be formed in the square or circular structure, and as shown in FIGS. 4A and 4B, at least one groove 410 may be formed at one side of the core 220 so as to fix the coil at any one side to the groove and allow the coil at the other side to be wound along a side wall of the core 220 to thereby improve winding convenience of the coil 210.

FIGS. 5A to 5D are views showing a manufacturing method of an inductor according to the exemplary embodiment of the present invention.

Figure 5A:
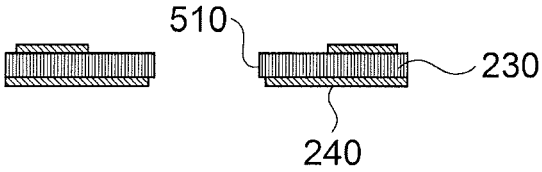
FIGS. 5A to 5D are views showing a manufacturing method of an inductor according to the exemplary embodiment of the present invention.
Figure 5B:
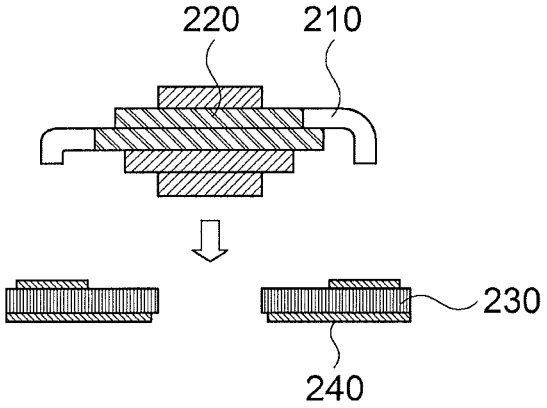
Figure 5C:
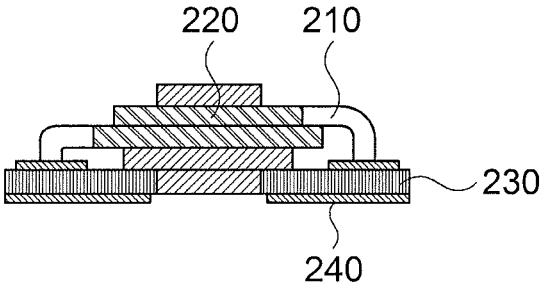

Referring to FIGS. 5A to 5D, the PCB 230 is formed with a pattern and an insertion part (for example, a hole or a groove) 510 for inserting the protrusion part formed in the core 220 as shown in FIG. 5A, and a protrusion part of a coil assembly 520 in which the coil 210 is wound around the core 220 (that is, the protrusion part formed at the lower portion of the core 220) is inserted and fixed into the insertion part 510 of the PCB 230 as shown in FIGS. 5B and 5C.

Each end portion of the coil 210 wound around the fixed core 220 is treated so as to be electrically connected to the lower PCB terminal 240. The coil 210 and the lower PCB terminal 240 are electrically connected, for example, by at least one method among a laser welding method, a spot welding method, an ultrasonic welding method, a conductive adhesive bonding method, and the like.

Although the case of inserting and fixing the core 220 into the insertion part 510 of the PCB 230 in a state in which the coil 210 is wound therearound (that is, in a coil assembly 520 state) is shown in FIGS. 5A to 5D, only the core 220 is inserted into the PCB 230 and fixed thereto, and then, the coil 210 may be wound therearound.

Figure 5D:
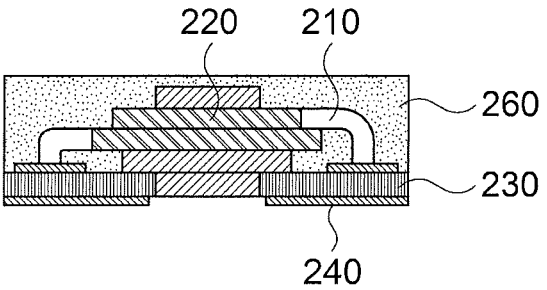

Thereafter, as shown in FIG. 5D, an appearance of the inductor is formed using the filler 260 so that the coil 210, the core 220 having the coil 210 wound therearound, and an exposed upper surface of the PCB 230 are received in the inductor.

According to the exemplary embodiment of the present invention, the inductor capable of being miniaturized and having excellent mounting capability on the substrate may be manufactured.

In addition, the inductor capable of maximizing the filling ratio and simultaneously implementing large capacity and thinness may be manufactured by including the core in order to efficiently mount an internal electrode and using a material having a magnetic property as the core material.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

What is claimed is:

1. An inductor comprising:

a PCB including an insertion part formed therein;

a coil assembly including a core and a coil wound around the core and positioned on the PCB so that a protrusion part formed so as to protrude at a lower portion of the core is inserted and fixed into the insertion part, wherein a size of the protrusion part is less than the core, and the protrusion part is formed so as to penetrate the PCB and a bottom of the protrusion part is exposed to an outside of the PCB;

a lower PCB terminal disposed at a lower portion of the PCB and penetrating through the PCB to thereby be electrically connected to the coil; and a filler forming an appearance so that the core, the coil, and an upper exposed surface of the PCB are received therein.

2. The inductor according to claim 1, wherein a content of a resin configuring the core is less than 1 wt %, and a content of a resin configuring the filler is an arbitrary value of 4 to 10 wt %.

3. The inductor according to claim 1, wherein at least one groove is formed at one side of the core.

4. The inductor according to claim 1, wherein the coil and the lower PCB terminal are electrically connected by at least one method among a laser welding method, a spot welding method, an ultrasonic welding method, and a conductive adhesive bonding method.

5. A manufacturing method of an inductor, the method comprising:

positioning a printed circuit board (PCB) including a lower PCB terminal formed thereon and an insertion part formed at one side thereof;

fixing a protrusion part formed at a lower portion of a core so as to be inserted into the insertion part, wherein a bottom of the protrusion part is exposed an outside of the PCB;

electrically connecting both ends of a coil wound around the core to the lower PCB terminal disposed at a lower portion of the PCB, respectively; and forming a filler so that the core, the coil, and an upper exposed surface of the PCB are received therein.

6. The manufacturing method according to claim 5, wherein the fixing of the protrusion part is fixing a coil assembly in which the coil is wound on a circumferential surface of the core so as to be inserted into the insertion part.

7. The manufacturing method according to claim 5, wherein the fixing of the protrusion part includes:

fixing the protrusion part formed at the lower portion of the core so as to be inserted into the insertion part; and winding the coil on a circumferential surface of the fixed core.

8. The inductor according to claim 2, wherein at least one groove is formed at one side of the core.

* * * * *